US009829250B2

(12) United States Patent
Matusewicz et al.

(10) Patent No.: US 9,829,250 B2
(45) **Date of Patent: *Nov. 28, 2017**

(54) FLUID COOLED LANCES FOR TOP SUBMERGED INJECTION

(71) Applicant: OUTOTEC OYJ, Espoo (FI)

(72) Inventors: Robert Matusewicz, Oakleigh (AU); Markus Reuter, Helsinki (FI)

(73) Assignee: Outotec Oyj, Espoo (FI)

( * ) Notice: Subject to any disclaimer, the term of this patent is extended or adjusted under 35 U.S.C. 154(b) by 250 days.

This patent is subject to a terminal disclaimer.

(21) Appl. No.: 14/361,043

(22) PCT Filed: Nov. 26, 2012

(86) PCT No.: PCT/IB2012/056714

§ 371 (c)(1),
(2) Date: May 28, 2014

(87) PCT Pub. No.: WO2013/080110

PCT Pub. Date: Jun. 6, 2013

(65) Prior Publication Data

US 2014/0327194 A1 Nov. 6, 2014

(30) Foreign Application Priority Data

Nov. 30, 2011 (AU) ..... 2011904988

(51) Int. Cl.
*C22B 15/00* (2006.01)
*F27D 3/16* (2006.01)
(Continued)

(52) U.S. Cl.
CPC ..... *F27D 3/16* (2013.01); *C21C 5/4613* (2013.01); *F27D 3/18* (2013.01);
(Continued)

(58) Field of Classification Search
CPC ..... F27D 2003/169; C21C 2005/4626
(Continued)

(56) References Cited

U.S. PATENT DOCUMENTS 3,223,398 A 12/1965 Bertram et al.
3,269,829 A 8/1966 Belkin
(Continued)

FOREIGN PATENT DOCUMENTS

AU 707438 B2 7/1999
CN 1040908 C 11/1998
(Continued)

OTHER PUBLICATIONS

International Search Report for PCT/AU2012/001001 completed Sep. 14, 2012, dated Sep. 17, 2012, 4 pages.
(Continued)

*Primary Examiner* — Scott Kastler
(74) *Attorney, Agent, or Firm* — Chernoff Vilhauer LLP

(57) ABSTRACT

A TSL lance has an outer shell of three substantially concentric lance pipes, at least one further lance pipe concentrically within the shell, and an annular end wall at an outlet end of the lance which joins ends of outermost and innermost lance pipes of the shell at an outlet end of the lance and is spaced from an outlet end of the intermediate lance pipe of the shell. Coolant fluid is able to be circulated through the shell, by flow to and away from the outlet end. The spacing between the end wall and the outlet end of the intermediate pipe provides a constriction to the flow of coolant fluid to increase coolant fluid flow velocity therebetween. The further lance pipe defines a central bore and is spaced from the innermost lance pipe of the shell to define an annular passage, whereby materials passing along the bore and the passage mix adjacent to the outlet end of the lance. The end
(Continued)

wall and an adjacent minor part of the length of the shell comprise a replaceable lance tip assembly.

19 Claims, 2 Drawing Sheets

(51) Int. Cl.
*C21C 5/46* (2006.01)
*F27D 3/18* (2006.01)
*F27D 9/00* (2006.01)

(52) U.S. Cl.
CPC ..... *C21C 2005/4626* (2013.01); *F27D 2003/164* (2013.01); *F27D 2003/169* (2013.01); *F27D 2009/0067* (2013.01)

(58) Field of Classification Search
USPC ..... 266/225
See application file for complete search history.

(56) References Cited

U.S. PATENT DOCUMENTS

| | | | |
|---|---|---|---|
| 3,321,139 | A | 5/1967 | De Saint Martin |
| 3,338,570 | A | 8/1967 | Zimmer |
| 3,411,716 | A | 11/1968 | Stephan et al. |
| 3,488,044 | A | 1/1970 | Shepherd |
| 3,521,872 | A | 7/1970 | Themelis |
| 3,730,505 | A | 5/1973 | Ramacciotti et al. |
| 3,802,681 | A | 4/1974 | Pfeifer |
| 3,828,850 | A | 8/1974 | McMinn et al. |
| 3,876,190 | A | 4/1975 | Johnstone et al. |
| 3,889,933 | A | 6/1975 | Jaquay |
| 4,023,676 | A | 5/1977 | Bennett et al. |
| 4,097,030 | A | 6/1978 | Desaar |
| 4,251,271 | A | 2/1981 | Floyd |
| 4,326,701 | A | 4/1982 | Hayden, Jr. et al. |
| 4,396,182 | A | 8/1983 | Schaffar et al. |
| 4,541,617 | A | 9/1985 | Okane et al. |
| 5,251,879 | A | 10/1993 | Floyd |
| 5,308,043 | A | 5/1994 | Floyd et al. |
| 5,498,277 | A | 3/1996 | Floyd |
| 5,615,626 | A | 4/1997 | Floyd et al. |
| 5,680,766 | A | 10/1997 | Joshi et al. |
| 6,565,800 | B2 | 5/2003 | Dunne |
| 9,528,766 | B2 * | 12/2016 | Matusewicz ..... C21C 5/4613 |
| 2014/0327194 | A1 * | 11/2014 | Matusewicz ..... C21C 5/4613 266/225 |

FOREIGN PATENT DOCUMENTS

| | | | |
|---|---|---|---|
| EP | 0535846 | A2 | 4/1993 |
| EP | 0644269 | A1 | 9/1994 |
| FR | 2432552 | | 2/1980 |
| GB | 876687 | A | 9/1961 |
| JP | 2000-258071 | A | 9/2000 |
| JP | 2001-226708 | A | 8/2001 |
| JP | 2002-048315 | A | 2/2002 |
| JP | 2006-046902 | A | 2/2006 |
| JP | 2009-139081 | A | 6/2009 |
| WO | 98/02588 | A1 | 1/1998 |
| WO | 01/81637 | A1 | 11/2001 |
| WO | 03/091460 | A1 | 11/2003 |
| WO | 2006/042363 | A1 | 4/2006 |

OTHER PUBLICATIONS

International Search Report for PCT/AU2012/000751 completed Jul. 24, 2012, dated Jul. 27, 2012, 4 pages.
International Search Report for PCT/IB2012/056714 completed Mar. 11, 2013, dated Mar. 18, 2013, 4 pages.
Office Action from corresponding Japanese Patent Application No. 2014-544008, dated Apr. 14, 2015, with English translation, 7 pgs.
Office Action from related Chinese patent Application No. 2012800591354, dated Mar. 31, 2015, 6 pgs., no English translation available.

* cited by examiner

FLUID COOLED LANCES FOR TOP SUBMERGED INJECTION

CROSS-REFERENCE TO RELATED APPLICATION

This is a national stage application filed under 35 USC 371 based on International Application No. PCT/IB2012/056714 filed Nov. 26, 2012, and claims priority under 35 USC 119 of Australian Patent Application No. 2011904988 filed Nov. 30, 2011.

FIELD OF THE INVENTION

This invention relates to top submerged injecting lances for use in molten bath pyrometallurgical operations.

BACKGROUND TO THE INVENTION

Molten bath smelting or other pyrometallurgical operations which require interaction between the bath and a source of oxygen-containing gas utilize several different arrangements for the supply of the gas. In general, these operations involve direct injection into molten matte/metal. This may be by bottom blowing tuyeres as in a Bessemer type of furnace or side blowing tuyeres as in a Peirce-Smith type of converter. Alternatively, the injection of gas may be by means of a lance to provide either top blowing or submerged injection. Examples of top blowing lance injection are the KALDO and BOP steel making plants in which pure oxygen is blown from above the bath to produce steel from molten iron. Another example of top Mitsubishi copper process, in which injection lances cause jets of oxygen-containing blowing lance injection is provided by the smelting and matte converting stages of the gas such as air or oxygen-enriched air, to impinge on and penetrate the top surface of the bath, respectively to produce and to convert copper matte. In the case of submerged lance injection, the lower end of the lance is submerged so that injection occurs within rather than from above a slag layer of the bath, to provide top submerged lancing (TSL) injection, a well known example of which is the Outotec Ausmelt TSL technology which is applied to a wide range of metals processing.

With both forms of injection from above, that is, with both top blowing and TSL injection, the lance is subjected to intense prevailing bath temperatures. The top blowing in the Mitsubishi copper process uses a number of relatively small steel lances which have an inner pipe of about 50 mm diameter and an outer pipe of about 100 mm diameter. The inner pipe terminates at about the level of the furnace roof, well above the reaction zone. The outer pipe, which is rotatable to prevent it sticking to a water-cooled collar at the furnace roof, extends down into the gas space of the furnace to position its lower end about 500-800 mm above the upper surface of the molten bath. Particulate feed entrained in air is blown through the inner pipe, while oxygen enriched air is blown through the annulus between the pipes. Despite the spacing of the lower end of the outer pipe above the bath surface, and any cooling of the lance by the gases passing through it, the outer pipe burns back by about 400 mm per day. The outer pipe therefore is slowly lowered and, when required, new sections are attached to the top of the outer, consumable pipe.

The lances for TSL injection are much larger than those for top blowing, such as in the Mitsubishi process described above. A TSL lance usually has at least an inner and an outer pipe, as assumed in the following, but may have at least one other pipe concentric with the inner and outer pipes. Typical large scale TSL lances have an outer pipe diameter of 200 to 500 mm, or larger. Also, the lance is much longer and extends down through the roof of a TSL reactor, which may be about 10 to 15 m tall, so that the lower end of the outer pipe is immersed to a depth of about 300 mm or more in a molten slag phase of the bath, but is protected by a coating of solidified slag formed and maintained on the outer surface of the outer pipe by the cooling action of the injected gas flow within. The inner pipe may terminate at about the same level as the outer pipe, or at a higher level of up to about 1000 mm above the lower end of the outer pipe. Thus, it can be the case that the lower end of only the outer pipe is submerged. In any event, a helical vane or other flow shaping device may be mounted on the outer surface of the inner pipe to span the annular space between the inner and outer pipes. The vanes impart a strong swirling action to an air or oxygen-enriched blast along that annulus and serve to enhance the cooling effect as well as ensure that gas is mixed well with fuel and feed material supplied through the inner pipe with the mixing occurring substantially in a mixing chamber defined by the outer pipe, below the lower end of the inner pipe where the inner pipe terminates a sufficient distance above the lower end of the outer pipe.

The outer pipe of the TSL lance wears and burns back at its lower end, but at a rate that is considerably reduced by the protective frozen slag coating than would be the case without the coating. However, this is controlled to a substantial degree by the mode of operation with TSL technology. The mode of operation makes the technology viable despite the lower end of the lance being submerged in the highly reactive and corrosive environment of the molten slag bath. The inner pipe of a TSL lance may be used to supply feed materials, such as concentrate, fluxes and reductant to be injected into a slag layer of the bath, or it may be used for fuel. An oxygen containing gas, such as air or oxygen enriched air, is supplied through the annulus between the pipes. Prior to submerged injection within the slag layer of the bath being commenced, the lance is positioned with its lower end, that is, the lower end of the outer pipe, spaced a suitable distance above the slag surface. Oxygen-containing gas and fuel, such as fuel oil, fine coal or hydrocarbon gas, are supplied to the lance and a resultant oxygen/fuel mixture is fired to generate a flame jet which impinges onto the slag. This causes the slag to splash to form, on the outer lance pipe, the slag layer which is solidified by the gas stream passing through the lance to provide the solid slag coating mentioned above. The lance then is able to be lowered to achieve injection within the slag, with the ongoing passage of oxygen-containing gas through the lance maintaining the lower extent of the lance at a temperature at which the solidified slag coating is maintained and protects the outer pipe.

With a new TSL lance, the relative positions of the lower ends of the outer and inner pipes, that is, the distance the lower end of the inner pipe is set back, if at all, from the lower end of the outer pipe, is an optimum length for a particular pyrometallurgical operating window determined during the design. The optimum length can be different for different uses of TSL technology. Thus, in a two stage batch operation for converting copper matte to blister copper with oxygen transfer through slag to matte, a continuous single stage operation for converting copper matte to blister copper, a process for reduction of a lead containing slag, or a process for the smelting an iron oxide feed material for the production of pig iron, all have different respective optimum mixing chamber length. However, in each case, the length of the mixing chamber progressively falls below the optimum for the pyrometallurgical operation as the lower end of the outer pipe slowly wears and burns back. Similarly, if there is zero offset between the ends of the outer and inner pipes, the lower end of the inner pipe can become exposed to the slag, with it also being worn and subjected to burn back. Thus, at intervals, the lower end of at least the outer pipe needs to be cut to provide a clean edge to which is welded a length of pipe of the appropriate diameter, to re-establish the optimum relative positions of the pipe lower ends to optimize smelting conditions.

The rate at which the lower end of the outer pipe wears and burns back varies with the molten bath pyrometallurgical operation being conducted. Factors which determine that rate include feed processing rate, operating temperature, bath fluidity and chemistry, lance flows rates, etc. In some cases the rate of corrosion wear and burn back is relatively high and can be such that in the worst instance several hours operating time can be lost in a day due to the need to interrupt processing to remove a worn lance from operation and replace it with another, whilst the worn lance taken from service is repaired. Such stoppages may occur several times in a day with each stoppage adding to non-processing time. While TSL technology offers significant benefits, including cost savings, over other technologies, any lost operating time for the replacement of lances carries a significant cost penalty.

With both top blowing and TSL lances, there have been proposals for fluid cooling to protect the lance from the high temperatures encountered in pyrometallurgical processes. Examples of fluid cooled lances for top blowing are disclosed in U.S. patents:

U.S. Pat. No. 3,223,398 to Bertram et al,
U.S. Pat. No. 3,269,829 to Belkin,
U.S. Pat. No. 3,321,139 to De Saint Martin,
U.S. Pat. No. 3,338,570 to Zimmer,
U.S. Pat. No. 3,411,716 to Stephan et al,
U.S. Pat. No. 3,488,044 to Shepherd,
U.S. Pat. No. 3,730,505 to Ramacciotti et al
U.S. Pat. No. 3,802,681 to Pfeifer,
U.S. Pat. No. 3,828,850 to McMinn et al,
U.S. Pat. No. 3,876,190 to Johnstone et al,
U.S. Pat. No. 3,889,933 to Jaquay,
U.S. Pat. No. 4,097,030 to Desaar,
U.S. Pat. No. 4,396,182 to Schaffar et al,
U.S. Pat. No. 4,541,617 to Okane et al; and
U.S. Pat. No. 6,565,800 to Dunne.

All of these references, with the exception of U.S. Pat. No. 3,223,398 to Bertram et al and U.S. Pat. No. 3,269,829 to Belkin, utilise concentric outermost pipes arranged to enable fluid flow to the outlet tip of the lance along a supply passage and back from the tip along a return passage, although Bertram et al use a variant in which such flow is limited to a nozzle portion of the lance. While Belkin provides cooling water, this passes through outlets along the length of an inner pipe to mix with oxygen supplied along an annular passage between the inner pipe and outer pipe, so as to be injected as steam with the oxygen. Heating and evaporation of the water provides cooling of the lance of Belkin, while stream generated and injected is said to return heat to the bath.

U.S. Pat. No. 3,521,872 to Themelis, U.S. Pat. No. 4,023,676 to Bennett et al and U.S. Pat. No. 4,326,701 to Hayden, Jr. et al purport to disclose lances for submerged injection. The proposal of Themelis is similar to that of U.S. Pat. No. 3,269,829 to Belkin. Each uses a lance cooled by adding water to the gas flow and relying on evaporation into the injected stream, an arrangement which is not the same as cooling the lance with water through heat transfer in a closed system. However, the arrangement of Themelis does not have an inner pipe and the gas and water are supplied along a single pipe in which the water is vaporized. The proposal of Bennett et al, while referred to as a lance, is more akin to a tuyere in that it injects, below the surface of molten ferrous metal, through the peripheral wall of a furnace in which the molten metal is contained. In the proposal of Bennett et al, concentric pipes for injection extend within a ceramic sleeve while cooling water is circulated through pipes encased in the ceramic. In the case of Hayden, Jr. et al, provision for a cooling fluid is made only in an upper extent of the lance, while the lower extent to the submergible outlet end comprises a single pipe encased in a refractory cement.

Limitations of the prior art proposals are highlighted by Themelis. The discussion is in relation to the refining of copper by oxygen injection. While copper has a melting point of about 1085° C., it is pointed out by Themelis that refining is conducted at a superheated temperature of about 1140° C. to 1195° C. At such temperatures lances of the best stainless or alloy steels have very little strength. Thus, even top blowing lances typically utilize circulated fluid cooling or, in the case of the submerged lances of Bennett and Hayden, Jr, et al, a refractory or ceramic coating. The advance of U.S. Pat. No. 3,269,829 to Belkin, and the improvement over Belkin provided by Themelis, is to utilize the powerful cooling able to be achieved by evaporation of water mixed within the injected gas. In each case, evaporation is to be achieved within, and to cool, the lance. The improvement of Themelis over Belkin is in atomization of the coolant water prior to its supply to the lance, avoiding the risks of structural failure of the lance and of an explosion caused by injection of liquid water within the molten metal.

U.S. Pat. No. 6,565,800 to Dunne discloses a solids injection lance for injecting solid particulate material into molten material, using an unreactive carrier. That is, the lance is simply for use in conveying the particulate material into the melt, rather than as a device enabling mixing of materials and combustion. The lance has a central core tube through which the particulate material is blown and, in direct thermal contact with the outer surface of the core tube, a double-walled jacket through which coolant such as water is able to be circulated. The jacket extends along a part of the length of the core tube to leave a projecting length of the core tube at the outlet end of the lance. The lance has a length of at least 1.5 meters and from the realistic drawings, it is apparent that the outside diameter of the jacket is of the order of about 12 cm, with the internal diameter of the core tube of the order of about 4 cm. The jacket comprises successive lengths welded together, with the main lengths of steel and the end section nearer to the outlet end of the lance being of copper or a copper alloy. The projecting outlet end of the inner pipe is of stainless steel which, to facilitate replacement, is connected to the main length of the inner pipe by a screw thread engagement.

The lance of U.S. Pat. No. 6,565,800 to Dunne is said to be suitable for use in the Hlsmelt process for production of molten ferrous metal, with the lance enabling the injection of iron oxide feed material and carbonaceous reductant. In this context, the lance is exposed to hostile conditions, including operating temperatures of the order of 1400° C. However, as indicated above with reference to Themelis, copper has a melting point of about 1085° C. and even at temperatures of about 1140° C. to 1195° C., stainless steels have very little strength. Perhaps the proposal of Dunne is suitable for use in the context of the Hlsmelt process, given the high ratio of about 8:1 in cooling jacket cross-section to the cross-section of the core tube, and the small overall cross-sections involved. The lance of Dunne is not a TSL lance, nor is it suitable for use in TSL technology.

Examples of lances for use in pyrometallurgical processes based on TSL technology are provided by U.S. Pat. Nos. 4,251,271 and 5,251,879, both to Floyd and U.S. Pat. No. 5,308,043 to Floyd et al. As detailed above, slag initially is splashed by using the lance for top blowing top blowing onto a molten slag layer to achieve a protective coating of slag on the lance which is solidified by high velocity top blown gas which generates the splashing. The solid slag coating is maintained despite the lance then being lowered to submerge the lower outlet end in the slag layer to enable the required top submerged lancing injection within the slag. The lances of U.S. Pat. Nos. 4,251,271 and 5,251,879, both to Floyd, operate in this way with the cooling to maintain the solid slag layer being solely by injected gas in the case of U.S. Pat. No. 4,251,271 and by that gas plus gas blown through a shroud pipe in the case of U.S. Pat. No. 5,251,879. However, with U.S. Pat. No. 5,308,043 to Floyd et al cooling, additional to that provided by injected gas and gas blown through a shroud pipe, is provided by cooling fluid circulated through annular passages defined by the outer three pipes of the lance. This is made possible by provision of an annular tip of solid alloy steel which, at the outlet end of the lance, joins the outermost and innermost of those three pipes around the circumference of the lance. The annular tip is cooled by injected gas and also by coolant fluid which flows across an upper end face of the tip. The solid form of the annular tip, and its manufacture from an alloy steel, result in the tip having a good level of resistance to wear and burn back. The arrangement is such that a practical operating life is able to be achieved with the lance before it is necessary to replace the tip in order to safeguard against a risk of failure of the lance enabling cooling fluid to discharge within the molten bath.

The present invention relates to an improved fluid cooled, top submerged injecting lance for use in TSL operations. The lance of the present invention provides an alternative choice to the lance of U.S. Pat. No. 5,308,043 to Floyd et al but, at least in preferred forms, can provide benefits over the lance of that patent.

SUMMARY OF THE INVENTION

In a first aspect, the present invention provides a lance for top submerged lancing injection within a slag layer of a molten bath, wherein the lance has an outer shell of three substantially concentric lance pipes and, at least one further lance pipe included and arranged substantially concentrically within the shell. At an outlet end of the lance, there is an annular end wall which joins the respective end of the outermost and innermost lance pipes of the shell at an outlet end of the lance and is spaced from the outlet end of the intermediate lance pipe of the shell. The arrangement is such that coolant fluid is able to be circulated through the shell of the lance, such as along the shell to the outlet end by flow between the innermost and intermediate lance pipes of the shell and then back along the lance, away from the outlet end, by flow between the intermediate and outermost lance pipes of the shell, or the converse of this flow arrangement. The end wall, and an adjacent minor part of the length of each of the three lance pipes of the shell, comprises a replaceable lance tip assembly, whereby a burnt back or worn lance tip assembly is able to be cut from a major part of the length of each of the three lance pipes to enable a new or repaired lance tip assembly to be welded in place. The end wall of the shell is at and defines the outlet end of the lance. Also, the at least one further lance pipe defines a central bore, and the at least one further lance pipe is spaced from the innermost lance pipe of the shell to define therebetween an annular passage, whereby materials passing along the bore and the passage are able to mix adjacent to the outlet end of the lance in being injected within the slag layer.

The TSL lance of the invention necessarily is of large dimensions. Also, at a location remote from the outlet end, such as adjacent to an upper or inlet end, the lance has a structure by which it is suspendable so as to hang down vertically within a TSL reactor. The lance has a minimum length of about 7.5 meters, such as for a small special purpose TSL reactor. The lance may be up to about 25 meters in length, or even greater, for a special purpose large TSL reactor. More usually, the lance ranges from about 10 to 20 meters in length. These dimensions relate to the overall length of the lance through to the outlet end defined by the end wall of the shell. The at least one further lance pipe may extend to the outlet end and therefore be of similar overall length. However, the at least one further lance pipe may terminate a short distance, inwardly of the outlet end, of for example up to about 1000 mm. The lance typically has a large diameter, such as set by an internal diameter for the shell of from about 100 to 650 mm, preferably about 200 to 6500 mm, and an overall diameter of from 150 to 700 mm, preferably about 250 to 550 mm.

The end wall is spaced from the outlet end of the intermediate lance pipe of the shell. However, the spacing between that outlet end and the end wall is such as to provide a constriction to flow of the coolant fluid which causes an increase in the coolant fluid flow velocity across and between the end wall and the outlet end of the intermediate lance pipe. The arrangement may be such that the flow of coolant fluid across the end wall is in the form of a relatively thin film or stream, with the film or stream preferably operable to suppress turbulence in the coolant fluid. To enhance such flow, the end of the intermediate lance pipe of the shell may be suitably shaped. Thus, in one arrangement, the end of the intermediate lance pipe may define a peripheral bead which has a radially curved, convex surface which faces towards the end wall. With such bead, the end wall may be of a complementary concave form. For example, in radical cross-sections, the bead may be of bulbous or bull-nose form, or it may be of a tear drop, or similar rounded form, while the end wall may have a concave, hemi-toroidal form. With such opposed convex and concave forms, the constriction between the outlet end of the intermediate lance pipe and the end wall is able to be of a substantial extent radially of the lance (i.e. in planes containing the longitudinal axis of the lance). This enables an increased ratio of surface to surface contact between the coolant fluid and each of the bead and the end wall, per unit mass flow of the coolant fluid, relative to coolant fluid flow along the lance up to the constriction, and thereby provides enhanced heat energy extraction from the outlet end of the lance.

In one arrangement, the bead at the outlet end of the intermediate lance pipe is of a tear drop shape, or substantially circular, in cross-sections (i.e. in planes containing the longitudinal axis of the lance). In such cases, the concave hemi-toroidal form of the end wall, by which the end wall is of complementary form to the bead, may be substantially semi-circular in cross-sections in those planes. As a consequence, the bead and the end wall are able to be closely adjacent so as to provide a constriction in the coolant fluid flow path which is able to extend through an angle of up to about 180°, such as from 90° to 180°, through which the coolant fluid flow path changes from flow towards the outlet end of the lance to flow away from the outlet end. Inevitably flow changes through an angle of about 180° simply due to a reversal in direction. However, unlike an arrangement in which the intermediate lance pipe does not provide a flow constriction, the provision of the constriction constrains the flow to a relatively thin film or stream which sweeps arcuately from the outer surface of the innermost lance pipe of the shell to the inner surface of the outermost lance pipe of the shell.

The constriction may continue from the bead, between the outer surface of the intermediate lance pipe and the inner surface of the outermost lance pipe. The constriction may extend over at least the axial length of the replaceable lance tip assembly, and result from the intermediate lance pipe being of increased thickness over such axial length relative to thickness of the innermost and outermost lance pipes. In such case the constriction between the intermediate and outermost lance pipes may be circumferentially continuous, or it may be discontinuous. In the latter case, the outer surface of the intermediate lance pipe may define ribs which extend away from the outlet end. The ribs may bear against the inner surface of the outermost lance pipe, with constricted flow able to occur between successive ribs. Alternatively, the ribs may be spaced slightly from the inner surface of the outermost lance pipe, with constricted flow able to occur between the ribs and the outermost lance pipe, and unconstricted or less constricted flow able to occur between successive ribs. The ribs may extend parallel to the axis of the lance or helically around that axis.

The shaping of the outlet end of the intermediate lance pipe, to provide a suitable constriction in the flow of coolant fluid, may be less pronounced than results from the provision of a bead. Over at least the axial length of the replaceable lance tip assembly, the intermediate lance pipe may be of increased thickness relative to the innermost and outermost lance pipes, such as detailed above. The shaping may comprise a rounding from the end of the intermediate lance pipe at the outlet end, around to the outer surface of the thickened length. The constriction may extend across that edge of the intermediate lance pipe to the outer surface of the thickened length. That outer surface may be circumferentially continuous or circumferentially discontinuous such as by the provision of ribs parallel to the lance axis or extending helically around that axis, as detailed above. Thus, the constriction is able to extend through an angle of at least 90°, with curvature of the end wall able to assist in that angle being in excess of 90°, such as up to about 120°.

In a second aspect, the lance of the present invention has a shroud through which the lance extends. The shroud has three substantially concentric shroud pipes of which an innermost shroud pipe has an internal diameter which is larger an outermost lance pipe of the TSL lance. At an outlet end of the shroud, there is an annular end wall which joins the respective outlet end of the outermost and innermost shroud pipes and is spaced from the outlet end of the intermediate shroud pipes. The arrangement is such that coolant fluid is able to be circulated through the shroud, such as along the shroud to the outlet end by flow between the innermost and intermediate shroud pipes and then back along the shroud, away from the outlet end, by flow between the intermediate and outermost shroud pipes, or the converse of this flow arrangement. The end wall, and an adjacent minor part of the length of each of the three shroud pipes, may comprise a replaceable shroud. Thus, a burnt back or worn shroud tip assembly is able to be cut from major part of the length of each of the three shroud pipes to enable a new or repaired shroud tip assembly to be welded in place.

The end wall is spaced from the outlet end of the intermediate shroud pipe. However, the spacing between that outlet end and the end wall is such as to provide a constriction to flow of the coolant fluid which causes an increase in the coolant fluid flow velocity across and between the end wall and the outlet end of the intermediate shroud pipe. The arrangement may be such that the flow of coolant fluid across the end wall is in the form of a relatively thin film or stream, with the film or stream preferably operable to suppress turbulence in the coolant fluid. To enhance such flow, the end of the intermediate shroud pipe may be suitably shaped. Thus, in one arrangement, the end of the intermediate shroud pipe may define a bead which has a radially curved, convex surface which faces towards the end wall. With such bead, the end wall may be of a complementary concave form. For example, the bead may be of a tear drop, or similar form, while the end wall may have a concave, hemi-toroidal form. With such opposed convex and concave forms, the constriction between the outlet end of the intermediate shroud pipe and the end wall is able to be of a substantial extent radially of the shroud (i.e. in planes containing the longitudinal axis of the shroud). This enables an increased ratio of surface to surface contact between the coolant fluid and each of the bead and the end wall, per unit mass flow of the coolant fluid, relative to coolant fluid along the shroud up to the constriction, and thereby provides enhanced heat energy extraction from the outlet end of the shroud. In one arrangement, the bead at the outlet end of the intermediate shroud pipe is of a tear drop shape, or substantially circular, in cross-sections (i.e. in planes containing the longitudinal axis of the shroud). In such cases, the concave hemi-toroidal form of the end wall, by which the end wall is of complementary form to the bead, may be substantially semi-circular in cross-sections in those planes. As a consequence, the bead and the end wall are able to be closely adjacent so as to provide a constriction in the coolant fluid flow path which is able to extend through an angle of up to about 180°, such as from 90° to 180°, through which the coolant fluid flow path changes from flow towards the outlet end of the shroud to flow away from the outlet end. Unlike an arrangement in which the intermediate shroud pipe does not provide a flow constriction, the provision of the constriction constrains the flow to a relatively thin film or stream which sweeps arcuately from the outer surface of the innermost shroud pipe to the inner surface of the outermost shroud pipe.

In parallel with the lance of the present invention, the constriction may continue from the bead, between the outer surface of the intermediate shroud pipe and the inner surface of the outermost shroud pipe. The constriction may extend over at least the axial length of the replaceable shroud tip assembly, and result from the intermediate shroud pipe being of increased thickness over such axial length relative to thickness of the innermost and outermost shroud pipes. In such case the constriction between the intermediate and outermost shroud pipes may be circumferentially continuous, or it may be discontinuous. In the latter case, the outer surface of the intermediate shroud pipe may define ribs which extend away from the outlet end. The ribs may bear against the inner surface of the outermost shroud pipe, with constricted flow able to occur between successive ribs. Alternatively, the ribs may be spaced slightly from the inner surface of the outermost shroud pipe, with constricted flow able to occur between the ribs and the outermost shroud pipe, and unconstricted or less constricted flow able to occur between successive ribs. The ribs may extend parallel to the axis of the shroud or helically around that axis.

The shaping of the outlet end of the intermediate shroud pipe, to provide a suitable constriction in the flow of coolant fluid, may be less pronounced than results from the provision of a bead. Over at least the axial length of the replaceable shroud tip assembly, the intermediate shroud pipe may be of increased thickness relative to the innermost and outermost shroud pipes, such as detailed above. The shaping may comprise a rounding from the end of the intermediate shroud pipe at the outlet end, around to the outer surface of the thickened length. The constriction may extend across that edge of the intermediate shroud pipe to the outer surface of the thickened length. That outer surface may be circumferentially continuous or circumferentially discontinuous such as by the provision of ribs parallel to the shroud axis or extending helically around that axis, as detailed above. Thus, the constriction is able to extend through an angle of at least 90°, with curvature of the end wall able to assist in that angle being in excess of 90°, such as up to about 120°.

In a third aspect, the present invention provides a lance according to the first aspect, in combination with a shroud according to the second aspect, with the lance and shroud being in an assembly in which the lance extends though the shroud to define an annular passage between the outermost on of the three lance pipes of the shell of the lance and the innermost shroud pipe, with the outlet of the shroud disposed intermediate of the ends of the lance and opening towards the outlet end of the lance.

A tip assembly according to the present invention has concentric inner and outer sleeve members which, at one end of the tip assembly, are joined together by the annular end wall. The tip assembly also has an intermediate sleeve member comprising a baffle which is located between the inner and outer sleeve members, adjacent to the end wall. The baffle has at least one surface portion thereof which co-operates with at least part of an opposed surface, of at least one of the end wall and the inner and outer sleeve members, to control the flow velocity of coolant fluid there-between for achieving heat energy extraction from the assembly.

The inner and outer sleeve members and the end wall by which they are joined may be formed integrally to comprise a single component of the tip assembly. For this purpose, they may be formed from a single piece of a suitable metal, such as a billet. The tip assembly is required to facilitate cooling, and the inner and outer sleeve members and the end wall therefore preferably are of a suitable material. In many instances materials of high thermal conductivity are appropriate, for example, copper or a copper alloy.

The baffle also may be of a material of high thermal conductivity, such as copper or a copper alloy. However the thermal conductivity of the baffle is less important since, in use, it is contacted by fluid coolant over substantially its entire surface area. The temperature of the baffle therefore will not rise above that of the fluid coolant. Thus, the material of which the baffle is made can be chosen for other reasons, such as cost, strength and ease of fabrication. The baffle may, for example, be made from a suitable steel, such as a stainless steel. The baffle may be formed from a suitable piece of material, or it may be cast and, if necessary, subjected to surface finishing at least at areas at which its surface is to co-operate to control coolant fluid flow velocity.

In the tip assembly, the baffle is maintained in a required position, relative to the inner and outer sleeve members and the end wall, by being connected in relation to those members and wall. For this purpose, the baffle may be secured to the end wall, one of the inner and outer sleeve members, or to an annular extension of one of the sleeve members. As a practical matter, it is more convenient to provide the securement to a sleeve member, or to an extension of a sleeve member. However, in each case, the securement preferably is such as to allow fluid flow between the baffle and the member, extension or wall to which it is secured. For this purpose, the securement is provided at a plurality of circumferentially spaced locations. Most conveniently the securement is by a respective fin, block or locking device at each location which is attached, such as by welding, to the baffle and to the member, extension or wall to which the baffle is secured. However, in an alternative arrangement, with the tip assembly connected as part of a lance, the baffle may be longitudinally adjustable to enable variation in the level to which the constriction is able to reduce coolant fluid flow velocity. Such adjustment may, for example, be enabled by the intermediate pipe of the lance, to which the baffle is connected, being longitudinally adjustable relative to the innermost and outermost pipes of the lance.

In one suitable arrangement, the baffle is secured such that it's outer and end peripheral surfaces are closely adjacent to the opposed inner peripheral surface of the outer sleeve member and to the inner surface of the end wall, respectively. Additionally, with the baffle so secured, part of its inner peripheral surface adjacent to its end surface may be closely adjacent to part of the opposed outer peripheral surface of the inner sleeve member. The respective opposed surfaces may be substantially uniformly separated. The separation preferably is less than the separation between part of the inner peripheral surface of the baffle which is spaced from the end surface and the opposed outer peripheral surface of the inner sleeve member. The arrangement is such that coolant fluid is able to flow through the tip assembly, by passing between the baffle and the inner sleeve member towards the end wall, across the end wall and then between the baffle spaced from the end surface and the outer sleeve member away from the end wall. With such flow, the coolant fluid passing between the closely adjacent opposed surfaces is caused to increase in flow velocity relative to flow through a wider spacing between the baffle and the inner sleeve member. However, it is to be noted that the flow of the coolant fluid can be in the reverse direction to that indicated, with the arrangement between the baffle and the inner and outer sleeve members also correspondingly changed.

The outer peripheral surface of the baffle may be of substantially uniform circular cross-section where it is closely adjacent to the opposed inner surface of the outer sleeve member. There accordingly may be a substantially uniform passage of annular cross-section between those closely adjacent surfaces, designed to achieve adequate flow and velocity in order to promote heat transfer which ensures the surface temperature of the tip material remains below a temperature at which damage occurs. For example, the separation between those surfaces may be about 1 to 25 mm and more preferably 1 to 10 mm and this will vary according to the fluid used and the heat removal rate needed. However, in alternative arrangements, the outer surface of the baffle may be other than of substantially circular cross-section.

In a first alternative arrangement, the outer surface of the baffle may be "waisted", such that the spacing between the opposed surfaces increases in a direction away from the end surface of the baffle. In further alternatives, the outer surface of the baffle may have a single- or multi-start helical rib or groove formation which acts to generate a helical flow of coolant fluid. In another alternative, the outer surface of the baffle may have alternating ribs and grooves which extend in a direction away from the end surface of the baffle.

The tip assembly may be provided only at the outlet end of a lance. Alternatively, with a shrouded lance, a tip assembly may define the discharge end of either or both of the lance and its shroud.

Each of the lance and the shroud is of elongate form, with the shell of the lance and the shroud being of similar construction. The shroud, of course, is of larger diameter, while it also has a shorter length, than the shell of the lance. However, each of the shroud and the shell of the lance has three concentric pipes, comprising outer and inner pipes and an intermediate pipe. Also, each of the shroud and the shell may have a tip assembly provided at its discharge end. For ease of further description, the concentric pipes of both the shroud and the shell of the lance is referred to by the term "shell".

Where a tip assembly defines the discharge end of a shell (of a shroud or lance), the inner and outer pipes of the shell are joined in end to end relationship with the inner and outer sleeve member, respectively, of the tip assembly. Also, the intermediate pipe of the shell is coupled to the baffle of the tip assembly.

As indicated above, the inner and outer sleeve members and the end wall of the tip assembly may be of a material of high thermal conductivity, such as copper or a copper alloy. However the pipes of a shell need not have such a high thermal conductivity. They therefore can be made of a material chosen to meet other criteria, such as cost and/or strength. In one convenient arrangement, the inner and intermediate pipes are of stainless steel, such as 316L, with the outer pipe of a carbon steel. With the outer pipe, exposure to high temperatures and process gases rather than to the coolant fluid, such as water, is more likely to be the determinant of its effective working life, whereas resistance to corrosion by the coolant fluid is the relevant factor for the inner and intermediate pipes.

The inner and outer pipes most preferably are joined with the inner and outer sleeve members of the tip assembly by welding. Each pipe may be welded directly to the respective sleeve member. However for at least one pipe and the respective sleeve member, but preferably for each pipe and its sleeve member, each of the pipe and sleeve member may be welded to an extension tube provided there-between. At least, for example, where a weld is provided between a copper or copper alloy and a steel member, an aluminium bronze consumable preferably is used in forming the weld. The manner in which the intermediate pipe of the shell and the baffle of the tip assembly co-operate may be similar.

With each of the lance and the shroud of the present invention, the mass flow rate of coolant can be less than would be required were it not for the constriction. Thus pumps of lower output are able to be used for a given coolant fluid. A suitable mass flow rate will vary with the fluid coolant chosen. The coolant fluid mass flow rate for a given lance and coolant fluid is set by the cooling capacity required for a given pyrometallurgical process. Thus, the mass flow rate can vary quite substantially. In a preferred form of the invention, the flow of coolant fluid is linked to the outlet temperature of the coolant fluid. The lance therefore may be provided with a sensor for monitoring that temperature. The arrangement preferably is such that the energy used for circulating the coolant fluid is minimised, based on the heat removal demand at the time.

With use of water as the fluid coolant, the mass flow rate may be in the range of from 500 to 2,000 l/min for the lance and a similar flow for the shroud, depending on both the fluid used and the application. Again with water as the coolant fluid, the constriction preferably is such as to result in a fluid flow rate through the constriction which is higher than the flow rate upstream of the constriction by a factor of from about 6 to 20. Again, for water as the coolant fluid, the constriction for the shroud preferably results in an increase in flow rate of the same order as for the lance.

DETAILED DESCRIPTION OF THE INVENTION

In order that the invention may more readily be understood, reference now is directed to the accompanying drawings, in which.

Figure 1:
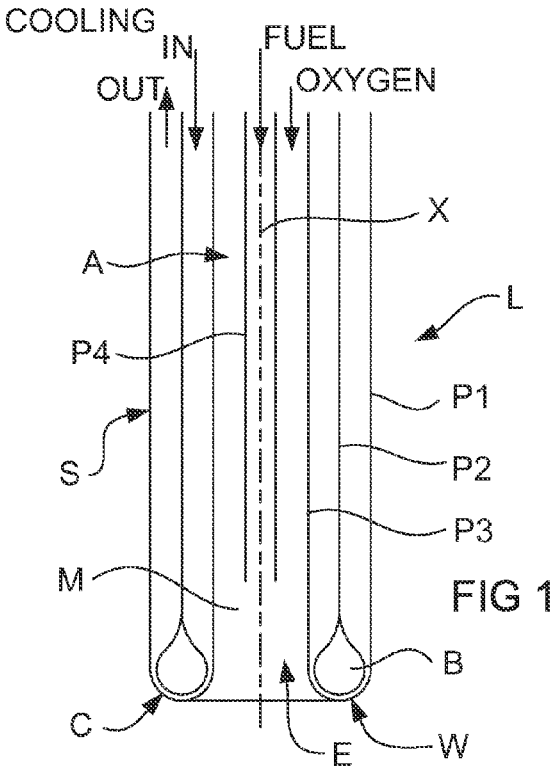
FIG. 1 is a schematic representation of one form of a lance according to the present invention.
Figure 3:
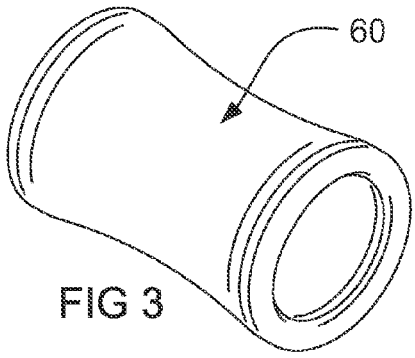
FIGS. 3 to 7 show respective perspective views of alternative forms for a component of the shrouded lance assembly of FIG. 2.

FIG. 1 schematically illustrates a TSL lance L according to one embodiment of the present invention. The lance L has four concentric pipes P1 to P4 of which pipes P1 to P3 form the main part of a shell S which also includes an annular end wall W. In the illustrated arrangement the lance L enables top submerged injection within the slag layer of a molten bath, for a required pyrometallurgical process, by injection of fuel down the bore of pipe P4 and injection of air and/or oxygen down through the annular passageway A between pipes P3 and P4. As shown, the pipe P4 terminates above the lower, outlet end E of lance L, to provide a mixing chamber M in which the fuel and air and/or oxygen are able to mix for combustion of the fuel. The ratio of fuel to oxygen is controlled in order to generate required oxidising, reducing or neutral conditions within the slag. Any fuel which is not combusted is injected within the slag to form part of reductant requirements when reducing conditions are necessary.

The end wall W of shell S joins the ends of pipes P1 and P3 around the full circumference of pipes P1 and P3 at the outlet end E of lance L. Also, the lower end of pipe P2 is spaced from end wall W. As shown, coolant fluid is able to be circulated through shell S. In FIG. 1, coolant fluid is shown as being supplied down between pipes P2 and P3 for flow around the lower end of pipe P2 and return up between pipes P1 and P2. However, the converse of this flow can be used if a lesser level of heat energy extraction from pipe P1, in particular, is appropriate.

Except at the lower end E of lance L, shell S has a substantially constant horizontal cross-sections in the normal in-use orientation shown. However, at end E, a constriction C is provided by the form of the lower end of pipe P2 and its co-operation with pipe P3 and end wall W. As shown, the lower end of pipe P2 carries an enlarged bead B having substantially the form of a torus so as to be of tear-drop shape, or substantially circular, in radial cross-sections (i.e. in planes containing the longitudinal axis X of lance L). Also, the surface of annular end wall W of shell S which faces bead B is of complementary concave hemi-toroidal form and bead B is positioned so that its lower convex surface is closely adjacent to but not in contact with the concave surface of end wall W. The arrangement is such that the flow velocity of coolant fluid is substantially constant in flow down between pipes P2 and P3 until it reaches the upper convex surface of bead B, after which the flow velocity progressively increases. The increase occurs in flow through an angle of about 90°, around the upper part of bead B, to a maximum around the lower half of bead in flow between bead B and end wall W. The maximum flow velocity is maintained in the flow of coolant fluid through an angle of about 180°, around the lower half of bead B. Thereafter the flow velocity decreases as the coolant fluid passes over the upper half of bead B until it reduces to a minimum in flow up between pipes P1 and P2. The constriction C is defined mainly by the spacing between the lower half of bead B and the end wall W, but the constriction C starts with the 90° of flow in pipe P3 around the upper surface of bead B.

The increase in coolant fluid flow velocity within constriction C increases the ratio of surface to surface contact, between the coolant fluid and each of bead B and end wall W, per unit mass flow rate of the coolant fluid. As a consequence, heat energy extraction from the outlet end E of lance L is enhanced. This is particularly beneficial as burn back and wear at the submerged lower end of the lance L tend to be greatest and sets the time interval between stoppages for lance repair.

Figure 2:
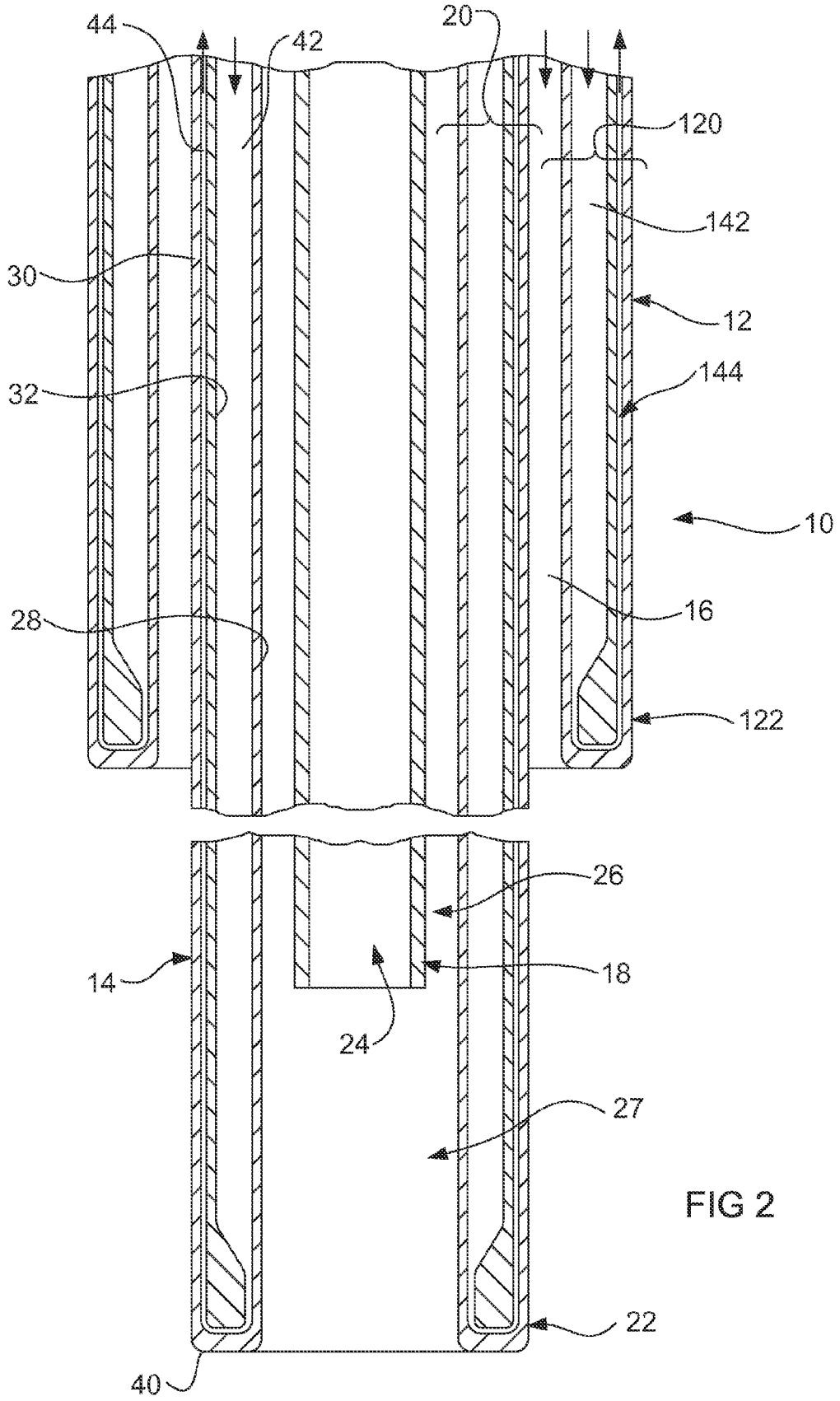
FIG. 2 is a sectional view of the lower part of a shrouded lance assembly according to the present invention.

The sectional view of FIG. 2 shows a shrouded lance assembly 10 in an in-use orientation. As shown, assembly 10 includes a plurality of concentric tubular members. These consist of members of an annular shroud 12, and members of a lance 14 which extends through shroud 12 to define an annular passage 16 there-between. FIG. 2 shows only the lower part of assembly 10. However, as is evident from FIG. 2, lance 14 is longer than shroud 12 and projects beyond shroud 12 at the lower end of assembly 10. The extent to which lance 14 projects beyond shroud 12 is not evident from FIG. 2, due to a section of lance 14 below shroud 12 being omitted in the in-use orientation shown.

The tubular members of lance 14 include an innermost pipe 18, and an outer shell 20 around pipe 18 which terminates at an annular tip assembly 22 at the lower end of shell 20. The pipe 18 is shorter than lance 14 so as to extends into and terminate within the annular tip assembly 22. Pipe 18 defines a central passage 24. Also an annular passage 26 is defined between pipe 18 and shell 20. The arrangement is such that carbonaceous fuel and oxygen-containing gas are able to be passed under pressure along respective passages 24 and 26, and mixed in a mixing chamber 27 at the end of pipe 18, within assembly 22, for combustion of the fuel and generation of a combustion region extending from chamber 27 and beyond assembly 22.

The shell 20 of lance 14 is formed by an inner pipe 28, an outer pipe 30 and an intermediate pipe 32, and an annular end wall 40 which joins the ends of pipes 28 and 30 around the full circumference of tip assembly 22. An annular passage 42 is defined between the inner pipe 28 intermediate pipes 32 of shell 20. Also, an annular passage 44 is defined between the intermediate pipe 32 outer pipe 30 of shell 20. The passages 42 and 44 are in communication due to the spacing between end wall 40 and the adjacent end of intermediate pipe 32. Thus, coolant fluid is able to be passed along passage 42, through shell 20 and its assembly 22 and then back along passage 44.

The intermediate pipe 32 of tip assembly 22 has a cylindrical outer surface which is closely adjacent to outer pipe 30. Thus passage 44 is relatively narrow in its radial extent, at least within assembly 22 but preferably also along the full extent of shell 20. While varying with the lance diameter, the spacing between the intermediate and outer pipes 32 and 30 within assembly 22, but preferably also along the full extent of shell 20, may be from about 5 mm to 10 mm, such as about 8 mm, and slightly greater a short distance above the bottom wall to at the lower end of the intermediate pipe 32. In contrast, passage 42 is relatively wide, such as between 15 to 30 mm between inner and intermediate pipe 28 and 32 of shell 20. However, the inner peripheral surface of intermediate pipe 32 within tip assembly 22 tapers frusto-conically so as to increase in thickness and decrease in internal diameter in a direction extending towards end wall 40. As a consequence, the radial extent of passage 42 progressively decreases within assembly 22. The decrease preferably is to a radial extent of passage 42 which is similar to that for passage 44. Also, the spacing between end wall 40 and the adjacent end of pipe 38 is similar to the radial extent of passage 44. Thus, coolant fluid supplied under pressure along passage 42 is caused to increase progressively in velocity in its flow between pipes 28 and 32, and to flow at a high flow velocity across end wall 40 and along passage 44. Accordingly, the coolant fluid is able to achieve a high level of heat energy extraction from external surfaces of lance 14, at its shell 20 and tip assembly 22 and, hence, safeguard against the effect of high temperatures to which the lance is exposed in use.

The end of lance 14 defining tip assembly 22 is the region most exposed to wear and burn back. The arrangement is such that the lower ends of pipes 28, 30 and 32 can be cut-off and a replacement tip assembly 22 installed, such as by welding. The length of cut-off and replaced can vary, such as in relation to the depth to which the outlet of lance 14 is submerged.

Intermediate pipe 32 of lance 14 may be maintained in a fixed relationship with pipes 28 and 30, and with end wall 40. This may be achieved by any convenient arrangement. A fixed relationship retains the flow path for cooling fluid along passage 42 and then back along passage 44 so that a required rate of heat energy extraction by the coolant fluid is able to be maintained, if necessary by varying the rate of supply of cooling fluid to passage 42. Establishing and maintaining the fixed relationship may be ensured by a few small dimples or other suitable form of spaced provided at locations around the upper surface of wall 40 or the end face of pipe 32. Such spacers also can assist in avoiding unwarranted development of vibrations in lance 14.

Turning now to shroud 12, it will be noted that apart from larger respective diameters of the pipes of which it is formed and the length of shroud 12, its construction is the same as that of shell 20 and its tip assembly 22. Accordingly, components of shroud 12 have the same reference numeral as used for shell 20 and its assembly 22, plus 100. Thus, further description of shroud 12 therefore is not necessary, beyond noting that it has a shell 120 and a tip assembly 122.

With use of lance assembly 10, the outer surface of lance 14 up to shroud 12 is provided with a coating of solidified slag, as described above, while such coating also may be formed on the lower extent of the outer surface of shroud 12. After this, the lower end of lance 14 is submerged to a required depth in a slag bath from which the coating was formed, but with the lower extent of shroud 12 spaced above the bath.

Pyrometallurgical reactions conducted in a reactor containing the slag bath usually result in combustible gases, principally carbon monoxide and hydrogen, evolving from the slag to the reactor space above the bath. If required, these gases can be subjected to post-combustion from which heat energy is able to be recovered by the slag. For this, oxygen containing gas can be supplied to the reactor space by being supplied to and issuing from the lower end of passage 16.

The principal cooling of shroud 12 is by coolant fluid circulated along passage 142 and back along passage 144, although some further cooling is achieved by the gas injected through passage 16, above the surface of the slag bath. With lance 14, substantial cooling is able to be achieved by the high velocity gas, sub-sonic injected through passage 26, while further substantial cooling is achieved by coolant fluid circulated along passage 42 and back along passage 44. The balance between the two cooling actions for lance 14 can be varied by changing the mass flow rate at which the coolant fluid is circulated. Again an increased flow rate of coolant fluid, relative to the flow rate in passage 42, caused by a constriction provided by the narrow extent of passage 44 (at least within assembly 22) enhances heat energy extraction from the assembly 22 and the lower extent of shell 20. As a consequence the operating life of the lance is increased by a resultant reduction in wear and burn back, particularly at assembly 22.

The arrangement with lance L of FIG. 1 and lance 10 of FIG. 2 is such that coolant fluid is able to be circulated through the shell of the lance, such as along the shell to the outlet end by flow between the innermost and intermediate lance pipes of the shell and then back along the lance, away from the outlet end, by flow between the intermediate and outermost lance pipes of the shell, or the converse of this flow arrangement. The respective end wall W,40 and an adjacent minor part of the length of each of the three lance pipes of the shell S,20, comprises a replaceable lance tip assembly, whereby a burnt back or worn lance tip assembly is able to be cut from a major part of the length of each of the three lance pipes to enable a new or repaired lance tip assembly to be welded in place. The end wall W,40 of the shell S,20 is at and defines the outlet end of the lance. Also, the at least one further lance pipe P4,18 defines a central bore 24, and the at least one further lance pipe P4,18 is spaced from the innermost lance pipe of the shell S,20 to define therebetween an annular passage A,42, whereby materials passing along the bore and the passage are able to mix adjacent to the outlet end of the lance in being injected within the slag layer.

The TSL lance L,10 necessarily is of large dimensions. Also, at a location remote from the outlet end, such as adjacent to an upper or inlet end, the lance has a structure (not shown) by which it is suspendable so as to hang down vertically within a TSL reactor. The lance L,10 has a minimum length of about 7.5 meters, but may be up to about 20 meters in length, or even greater, for a special purpose large TSL reactor. More usually, the lance ranges from about 10 to 15 meters in length. These dimensions relate to the overall length of the lance through to the outlet end defined by the end wall of the shell. The at least one further lance pipe P4,18 may extend to the outlet end and therefore be of similar overall length but, as shown, may terminate a short distance, inwardly of the outlet end, such as by up to about 1000 mm. The lance typically has a large diameter, such as set by an internal diameter for the shell of from about 100 to 650 mm, preferably about 200 to 500 mm, and an overall diameter of from 150 to 700 mm, preferably about 250 to 550 mm.

Each of FIGS. 3 to 7 illustrates schematically a respective, alternative form for the baffle comprising pipe 38 of tip assembly 22 of lance 14 and/or pipe 138 of shroud 12, although the baffle employed in lance 14 need not be of the same type as that used in shroud 12. The pipe 60 of FIG. 3 differs from pipe 38 or pipe 138 of FIG. 2. Each of pipes 38 and 138 has a cylindrical outer surface which is at a substantially constant spacing from the respective outer pipe 36, 136, such that a substantially constant coolant fluid flow velocity is maintained there-between in passage 44. In contrast, the outer surface of pipe 60 is profiled such that, in flowing upwardly in passage 44, a progressively decreasing fluid flow velocity is enabled after the decrease in flow velocity resulting from the larger external diameter at the lower end of pipe 60. Subject to the decrease not proceeding below a level providing for required heat energy removal from the outer pipe 36 and/or 136, good energy removal from the lower end of tip assembly 22 and/or 122 is able to be achieved.

Figure 4:
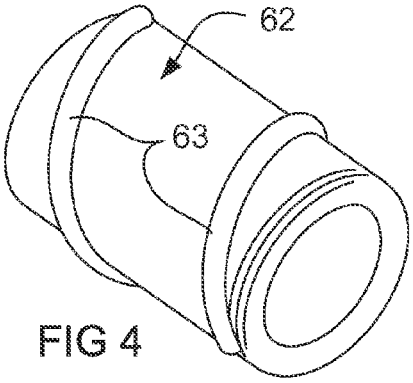
Figure 5:
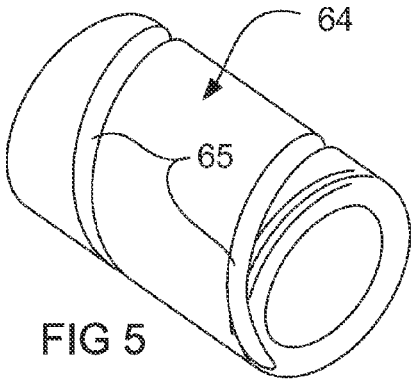

The respective pipes 62 and 64 of FIGS. 4 and 5 also differ at the outer surface from the arrangement of pipes 38, 138. While pipes 62 and 64 show respective forms, they achieve a similar result. In the case of pipe 62, a raised spiral, bead or ridge 63 extends in a helical formation around the cylindrical outer surface and may be continuous or intermittent, such as when a vane arrangement is employed. In contrast, the outer surface of pipe 64 has a helical groove 65 formed therein. In each case, coolant fluid is constrained to flow helically in passage 44 and/or 144, at least within the tip assembly 22 and/or 122. The bead or ridge 63 around pipe 62 is shown as being of rounded cross-section and it may be provided by wire tack-welded to pipe 62. However bead or ridge 63 can have other cross-sectional forms, while groove 65 of tube 64 can have a cross-sectional form other than the rectangular form shown.

Figure 6:
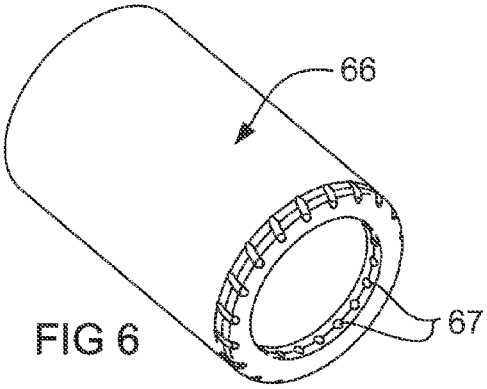

The pipe 66 of FIG. 6 is similar in overall form to pipes 38 and 138. However, it differs in having a circumferential array of holes 67 there-through adjacent to its lower end. Coolant fluid is able to pass through holes 67, additional to the flow passing around the lower end of pipe 66. Thus heat energy is able to be more effectively removed from the lower end of a lance 14 and/or 114 provided with a pipe 66.

Figure 7:
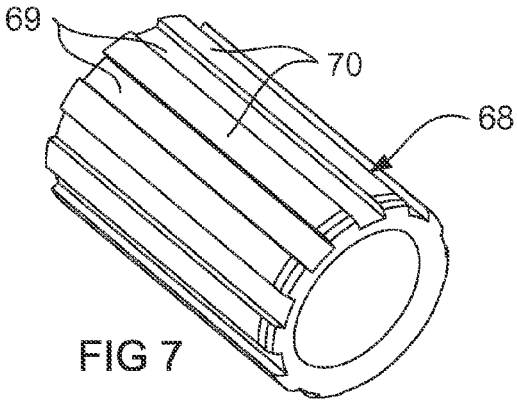

The pipe 68 of FIG. 7 is provided on its outer surface with an array of longitudinal flutes or grooves 69, resulting in longitudinal ridges 70. In this instance, the extent of increase in coolant fluid flow velocity is less than if grooves 69 had not been formed. That is, the flow velocity is dependent on the average radius of the outer surface of pipe 68.

The respective pipes 38 and 138 of the arrangement of FIG. 2, and the respective pipes 60, 62, 64, 66 and 68 of FIGS. 3 to 7, may be produced in any suitable way. For example, the pipes may be machined or forged from a billet of a suitable metal, or by casting a suitable metal substantially final form.

The coolant fluid may be of any suitable liquid or gas. A liquid cooling agent is preferred, and liquid coolants able to be used include water, ionic liquids and suitable polymer materials, including organosilicon compounds such as siloxanes. Examples of specific silicone polymers able to be used include the heat transfer fluids available under the trade mark SYLTHERM, owned by the Dow Corning Corporation.

Finally, it is to be understood that various alterations, modifications and/or additions may be introduced into the constructions and arrangements of parts previously described without departing from the spirit or ambit of the invention.

The invention claimed is:

1. A top submergible injection lance for use in a top submerged lancing injection within a slag layer of a molten bath in a pyrometallurgical process, wherein the lance has an outer shell of three substantially concentric lance pipes comprising an outermost, an innermost and an intermediate pipe, the lance including at least one further lance pipe arranged substantially concentrically within the shell, and further including an annular end wall at an outlet end of the lance which joins a respective end of the outermost and innermost lance pipes of the shell at an outlet end of the lance and is spaced from an outlet end of the intermediate lance pipe of the shell, wherein, at a location remote from the outlet end, adjacent to an upper or inlet end, the lance has a structure by which it is suspendable so as to hang down vertically, and the shell is adapted to circulate coolant fluid through the shell, by flow between the innermost and intermediate lance pipes to the outlet end and then back along the lance, away from the outlet end, by flow between the intermediate and outermost lance pipes, or the converse of this flow, wherein the spacing between the end wall and the outlet end of the intermediate pipe provides a constriction to the flow of coolant fluid operable to cause an increase in coolant fluid flow velocity between the end wall and the outlet end of the intermediate pipe;

wherein the at least one further lance pipe defines a central bore, whereby a mixing chamber is defined by the outer shell between the outlet ends of the outer shell and of the at least one further pipe, and the at least one further lance pipe is spaced from the innermost lance pipe of the shell to define therebetween an annular passage, whereby combustible material passing along the bore and oxygen containing gas passing along the annular passage are able to form a combustible mixture in the mixing chamber and adjacent to the outlet end of the lance for combustion of the mixture in being injected within the slag layer, and wherein the end wall and an adjacent minor part of the length of each of the three pipes of the shell comprise a replaceable lance tip assembly able to be cut from a major part of the length of the three pipes of the shell to enable replacement.

2. The lance of claim 1 wherein the constriction is operable to provide a flow of coolant fluid across the end wall in the form of a thin film or stream relative to flow before and after the constriction.

3. The lance of claim 1, wherein at the end of the intermediate lance pipe there is defined a bead which has a radially curved, convex surface which faces towards the end wall, due to the bead being of tear drop, or rounded form, with the end of complementary concave form.

4. The lance of claim 3, wherein the constriction between the outlet end of the intermediate pipe and the end wall is of located radially of the lance in planes containing an axis for the lance, with the bead and the end wail providing the constriction through an angle of up to about 180°.

5. The lance of claim 3, wherein the constriction continues from the bead, between the outer surface of the intermediate lance pipe and an inner surface of the outermost pipe, over at least part of the length of the lance along which the intermediate pipe is of increased wall thickness.

6. The lance of claim 1, wherein the constriction is defined at least in part from a rounding of the end of the intermediate pipe and between the outer surface of the intermediate pipe and the inner surface of the outermost pipe, over at least part of the length of the lance along which the intermediate pipe has an increased wall thickness, with the constriction extending through an angle of at least 90°.

7. The lance of claim 1, wherein the lance includes an annular shroud disposed concentrically around an upper extent of the shell spaced from the outlet end.

8. The lance of claim 7, wherein the shroud has an outer shell of three substantially concentric shroud pipes comprising an outermost, an innermost and an intermediate pipe, and further including an annular end wail at an outlet end of the shroud which joins a respective outlet end of the outermost and innermost shroud pipes of the shell and is spaced from an outlet end of the intermediate shroud pipe of the shell, whereby coolant fluid is able to be circulated through the shell, along the shell to the outlet end by flow between the innermost and intermediate shroud pipes and then back along the shroud, away from the outlet end, by flow between the intermediate and outermost shroud pipes, or the converse of this flow, and wherein the spacing between the end wail and the outlet end of the intermediate pipe provides a constriction to the flow of coolant fluid operable to cause an increase in coolant fluid flow velocity between the end wall and the outlet end of the intermediate pipe.

9. The lance of claim 8, wherein the constriction of the shroud is operable to provide a flow of coolant fluid across the end wall of the shroud in the form of a thin film or stream relative to flow before and after the constriction.

10. The lance of claim 8, wherein the end of the intermediate shroud pipe there is defined a bead which has a radially curved, convex surface which faces towards the end wail, due to the head being of tear drop, or rounded form, with the end of complementary concave form.

11. The lance of claim 10, wherein the constriction between the outlet end of the intermediate shroud pipe and the end wall is of located radially of the shroud in planes containing an axis for the shroud, with bead and the end wail are closely to provide the constriction through an angle of up to about 180°.

12. The lance of claim 11, wherein the constriction continues from the bead, between the outer surface of the intermediate shroud pipe and an inner surface of the outermost shroud pipe, over at least part of the length of the shroud along which the intermediate pipe is of increased wall thickness.

13. The lance of claim 9, wherein the constriction is defined at least in part from a rounding of the end of the intermediate shroud pipe and between the outer surface of the intermediate shroud pipe and the inner surface of the outermost shroud pipe, over at least part of the length of the shroud along which the intermediate pipe has an increased wall thickness, with the constriction extending through an angle of at least 90° up to about 120°.

14. The lance of claim 1, wherein the constriction results in a coolant fluid flow rate there-through which is higher than the flow rate upstream of the constriction by a factor of from about 6 to 20.

15. The lance of claim 1, wherein the lance is from about 7.5 to about 25 meters in length.

16. The lance of claim 1 wherein the shell of the lance has an internal diameter of from about 100 mm to 650 mm, and an external diameter of 150 mm to 700 mm.

17. The lance of claim 1, wherein the further lance pipe extends to the outlet end of the lance.

18. The lance of claim 1 wherein the further lance pipe terminates within the shell by up to 1000 mm from the outlet end.

19. The lance of claim 1, wherein the lance includes an annular shroud disposed concentrically around an upper extent of the shell and spaced from the upper end.

* * * * *